US009923340B2

(12) United States Patent
Wakazono

(10) Patent No.: US 9,923,340 B2
(45) Date of Patent: Mar. 20, 2018

(54) METHOD OF PRODUCING THREADED MEMBER, METHOD OF PRODUCING SPARK PLUG, AND APPARATUS FOR PRODUCING THREADED MEMBER

(71) Applicant: NGK Spark Plug Co., LTD., Nagoya (JP)

(72) Inventor: Reiji Wakazono, Kakamigahara (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 182 days.

(21) Appl. No.: 14/805,955

(22) Filed: Jul. 22, 2015

(65) Prior Publication Data

US 2016/0107221 A1 Apr. 21, 2016

(30) Foreign Application Priority Data

Oct. 21, 2014 (JP) ..... 2014-214226

(51) Int. Cl.
*B21H 3/04* (2006.01)
*H01T 21/02* (2006.01)
*H01T 13/08* (2006.01)

(52) U.S. Cl.
CPC ..... *H01T 21/02* (2013.01); *B21H 3/04* (2013.01); *H01T 13/08* (2013.01)

(58) Field of Classification Search
CPC ..... H01T 21/00; H01T 21/02; H01T 13/08; B21H 3/02; B21H 3/022; B21H 3/04; B21H 3/042
See application file for complete search history.

(56) References Cited

U.S. PATENT DOCUMENTS 6,566,793 B2 * 5/2003 Honda ..... H01T 13/20 313/140
7,772,751 B2 * 8/2010 Suzuki ..... H01T 21/02 313/118
8,156,779 B2 * 4/2012 Ohashi ..... B21H 3/042 72/10.7
2009/0007618 A1 1/2009 Ohashi et al.
2011/0183573 A1 * 7/2011 Ozeki ..... B21H 3/04 72/80

FOREIGN PATENT DOCUMENTS

JP 2008-153202 A 7/2008

* cited by examiner

*Primary Examiner* — R. K. Arundale
*Assistant Examiner* — Pradeep C Battula
(74) *Attorney, Agent, or Firm* — Leason Ellis LLP

(57) ABSTRACT

A workpiece having a first portion and a second portion is held. The first portion extends in the direction of a center axis of the workpiece, and a male thread is to be rolled on the first portion. The length of the second portion in a direction perpendicular to the center axis is longer than that of the first portion. The male thread is formed on the outer circumference of the first portion using two rolling dies through rolling. At least a first portion center axis that is a part of the center axis and corresponds to the first portion is separated in a prescribed direction from a first virtual plane containing the center axes of the two rolling dies. In the workpiece held, the first portion center axis is inclined such that its distance from the first virtual plane increases with distance from the second portion.

13 Claims, 10 Drawing Sheets

AN=atan((c−d)/25mm)

$$L=a-(b-\phi R/2)$$

$$AN=atan((c-d)/25mm)$$

| INCLINATION | | L(mm) | | | | | | | | | | | |
|---|---|---|---|---|---|---|---|---|---|---|---|---|---|
| c−d(mm) | ANGLE (rad x $10^{-4}$) | 0 | 0.005 | 0.03 | 0.05 | 0.07 | 0.1 | 0.15 | 0.2 | 0.25 | 0.3 | 0.35 | 0.4 |
| 0 | 0 | D | C | C | C | C | B | C | C | C | C | D | D |
| 0.005 | 2 | C | B | B | B | B | A | B | B | B | B | C | C |
| 0.02 | 8 | C | B | B | B | A | A | A | B | B | B | C | C |
| 0.04 | 16 | B | B | B | A | A | A | A | A | B | B | B | C |
| 0.06 | 24 | B | B | B | A | A | A | A | A | B | B | B | C |
| 0.08 | 32 | C | B | B | B | A | A | A | B | B | B | C | C |
| 0.1 | 40 | C | B | B | B | B | A | B | B | B | B | C | C |
| 0.12 | 48 | D | C | C | C | C | B | C | C | C | C | D | D |

FIG. 16

METHOD OF PRODUCING THREADED MEMBER, METHOD OF PRODUCING SPARK PLUG, AND APPARATUS FOR PRODUCING THREADED MEMBER

This application claims the benefit of Japanese Patent Application No. 2014-214226, filed Oct. 21, 2014 which is incorporated by reference in its entity herein.

FIELD OF THE INVENTION

The present invention relates to production of a threaded member.

BACKGROUND OF THE INVENTION

One known method of forming a male thread is rolling. Generally, two or three rolling dies are used for rolling. In one known method that uses two rolling dies, the center axis of a held workpiece is disposed in a virtual plane containing the center axes of the two rolling dies (for example, Japanese Patent Application Laid-Open (kokai) No. 2008-153202).

Problems to be Solved by the Invention

It has been found that, when the center axis of the workpiece is disposed in the above-described virtual plane as in the prior art, the workpiece exhibits a rising behavior during rolling, i.e., it rises in a direction orthogonal to the center axis of the workpiece. This rising behavior imposes a load on the mechanism for holding the workpiece. An object of the present invention is to reduce the load on the holding mechanism that is caused by the rising behavior.

SUMMARY OF THE INVENTION

Means for Solving the Problems

The present invention has been made in order to solve the above problem and can be embodied in the following modes.

(1) One mode of the present invention is a method of producing a threaded member, the method comprising holding a workpiece having a first portion which extends in a direction of a center axis of the workpiece and on which a male thread is to be rolled and a second portion whose length in a direction perpendicular to the center axis is longer than that of the first portion; and subjecting the first portion to rolling using two rolling dies to form the male thread on an outer circumference of the first portion, wherein at least a first portion center axis that is part of the center axis and corresponds to the first portion is separated in a prescribed direction from a first virtual plane that contains center axes of the two rolling dies, and in the workpiece held, the first portion center axis is inclined such that the distance of the first portion center axis from the first virtual plane increases with distance from the second portion. In this mode, the workpiece is disposed such that the first portion center axis is separated in the prescribed direction from the first virtual plane. In the workpiece held, the first portion center axis is inclined such that its distance from the first virtual plane increases with distance from the second portion. It has been found that this disposition can restrain the rising behavior. Therefore, in this mode, the load on the mechanism for holding the workpiece is reduced. Thereby, for example, a malfunction of the mechanism for holding the workpiece is restrained.

(2) In the above-described mode, the prescribed direction may be a vertically downward direction, and a minimum distance between the first portion center axis and the first virtual plane may be 0.005 mm or more and 0.3 mm or less. In this mode, the rising behavior of the workpiece is effectively restrained.

(3) In the above-described mode, a smaller one of angles formed by the first portion center axis and the first virtual plane may be $2\times10^{-4}$ rad or more and $40\times10^{-4}$ rad or less. In this mode, the rising behavior of the workpiece is effectively restrained.

(4) In the above-described mode, during the rolling, the workpiece may be held by a holding mechanism extending along a holding mechanism center axis, and a smaller one of angles formed by the first portion center axis and a projection line formed by projecting the holding mechanism center axis onto a second virtual plane may be allowed to be larger than 0 degrees, the second virtual plane being perpendicular to the first virtual plane and containing the first portion center axis. In this mode, the rising behavior of the workpiece is effectively restrained. As described in relation to the mode, the workpiece is inclined with respect to the rolling dies, and force acts on the workpiece along the rolling dies during rolling. However, in this mode, since the center axis of the workpiece is allowed to skew from the holding mechanism center axis, the skew restrains the rising behavior.

(5) In the above-described mode, the workpiece may have a hollow space. The load on the holding mechanism tends to be large when the workpiece is a hollow member. However, according to this mode, the load can be reduced although the workpiece has a hollow space.

(6) In the above-described mode, during the rolling, the workpiece may be held through an inner wall surface of the workpiece which defines the hollow space. The load on the holding mechanism tends to be large when the workpiece is held through the inner wall surface defining the hollow space. However, according to this mode, the load on the holding mechanism can be reduced even when the workpiece is held through the inner wall surface defining the hollow space.

(7) In the above-described mode, the male thread may have a thread reach of 12 mm or more. The load on the holding mechanism tends to be large when a threaded member having a large thread reach is produced. However, according to this mode, the load can be reduced even when such a threaded member is produced.

(8) In the above-described mode, the workpiece may include a rod-shaped member extending from a forward end of the workpiece, and adjustment of a circumferential position of the rod-shaped member about the center axis of the workpiece and adjustment of angular positions of the two rolling dies may be performed before the rolling. According to this mode, the point at which threading is started with respect to the position of the rod-shaped member can be controlled.

(9) In the above-described mode, the Vickers hardness of the first portion may be 310 Hv or less before the rolling. According to this mode, the load on the holding mechanism can be reduced. This is because, when the Vickers hardness of the workpiece is low, reaction force acting on the rolling dies is small and therefore the force causing rising of the workpiece is small.

(10) In the above-described mode, the male thread may be a male thread formed on a metallic shell for a spark plug. According to this mode, the male thread can be applied to the metallic shell for the spark plug.

The present invention can be embodied in various modes different from the above modes. For example, the present invention can be embodied as a method of producing a spark plug and a threaded member production apparatus.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 16 is a table showing the relation between the disposition of the intermediate assembly and the degree of restraint on the rising behavior.

DETAILED DESCRIPTION OF THE INVENTION

Modes for Carrying Out the Invention

Figure 1:
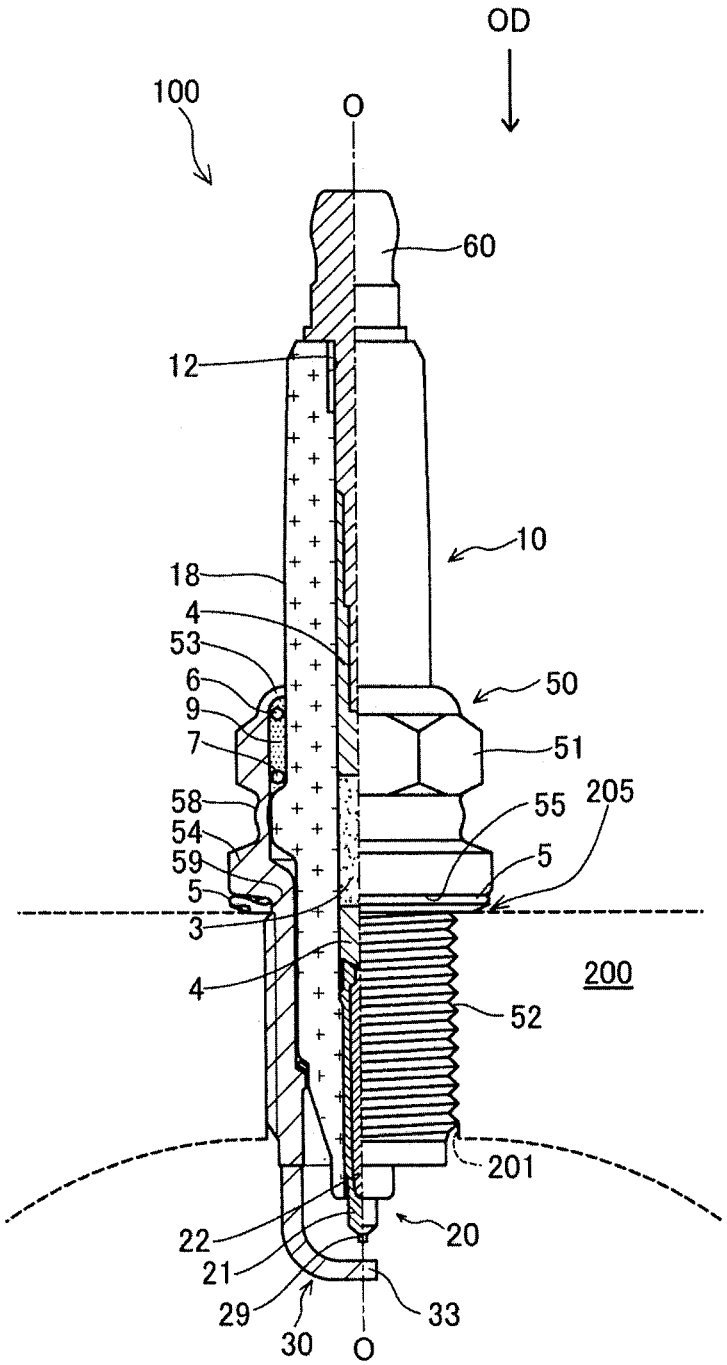
FIG. 1 is a partial cross-sectional view illustrating a spark plug.

FIG. 1 is a partial cross-sectional view illustrating a spark plug 100. The structure of the spark plug 100 will first be described, and a method of producing the spark plug 100 (including a method of producing a metallic shell assembly 350 used as a threaded member) will be described later.

In the following description, an axial direction OD shown in FIG. 1 is defined as the vertical direction in FIG. 1. The lower side in FIG. 1 is defined as the forward end side of the spark plug, and the upper side is defined as the rear end side thereof. In FIG. 1, the external appearance of the spark plug 100 is shown on the right side of an axial line O, and a cross section of the spark plug 100 is shown on the left side of the axial line O.

The spark plug 100 is a device to be attached to an engine head 200 of a gasoline engine and generates spark discharge between electrodes at the forward end of the spark plug 100 in order to ignite an air-fuel mixture in a combustion chamber.

The spark plug 100 includes an insulator 10, a center electrode 20, a ground electrode 30, a terminal electrode 60, and a metallic shell 50. The insulator 10 is a member serving as an insulating material and has an axial hole 12 extending along the axial line O. The center electrode 20 is a rod-shaped electrode extending along the axial line O and is inserted into and held within the axial hole 12 of the insulator 10. The metallic shell 50 is a tubular member surrounding the outer circumference of the insulator 10, and the insulator 10 is fixed inside the metallic shell 50.

One end of the ground electrode 30 is fixed to the forward end of the metallic shell 50, and the other end faces the center electrode 20. The terminal electrode 60 is a terminal for receiving electric power and is electrically connected to the center electrode 20. When a high voltage is applied between the terminal electrode 60 and the engine head 200 with the spark plug 100 attached to the engine head 200, spark discharge occurs between the center electrode 20 and the ground electrode 30. The details of each component will next be described.

The insulator 10 is a tubular insulator formed of ceramic, and the axial hole 12 extending in the axial direction OD is formed along the axial line O.

The center electrode 20 is a rod-shaped member disposed inside the axial hole 12 of the insulator 10 and extending from the rear end side toward the forward end side. The forward end of the center electrode 20 protrudes from the forward end of the insulator 10. An electrode tip 29 is provided at the forward end of the center electrode 20. The electrode tip 29 is formed of a platinum alloy, an iridium alloy, etc., and welded to the forward end of an electrode base metal 21.

The center electrode 20 has a structure in which a core 22 is embedded in the electrode base metal 21. The electrode base metal 21 is formed of a nickel alloy such as INCONEL 600 (INCONEL is a registered trademark). The core 22 is formed of a metal having a thermal conductivity higher than that of the electrode base metal 21. Specifically, the core 22 is formed of any of copper and alloys formed mainly of copper.

In the axial hole 12 of the insulator 10, a seal 4 and a ceramic resistor 3 are disposed rearward of the center electrode 20. The center electrode 20 is electrically connected to the terminal electrode 60 through the seal 4 and the ceramic resistor 3.

The metallic shell 50 is a tubular metallic member, and the insulator 10 is held inside the metallic shell 50. A tool engagement portion 51 and a male threaded portion 52 are formed on the outer circumference of the metallic shell 50. The tool engagement portion 51 is a portion to which a spark plug wrench (not shown) is to be fitted.

The male threaded portion 52 of the metallic shell 50 has a thread formed thereon and is to be screwed into a mounting threaded hole 201 of the engine head 200. The male threaded portion 52 is a right-hand thread, and the nominal diameter of the male threaded portion 52 is M14. The spark plug 100 is fixed to the engine head 200 by screwing the male threaded portion 52 of the metallic shell 50 into the mounting threaded hole 201 of the engine head 200 and tightening the male threaded portion 52.

A flange portion 54 protruding radially outward is formed between the tool engagement portion 51 and male threaded portion 52 of the metallic shell 50. An annular gasket 5 is fitted to a screw neck 59 between the male threaded portion 52 and the flange portion 54. The gasket 5 is formed by folding a plate. When the spark plug 100 is attached to the engine head 200, the gasket 5 is crushed and deformed between a seat surface 55 of the flange portion 54 and a mounting surface 205 around the opening of the mounting threaded hole 201. The deformation of the gasket 5 provides a seal between the spark plug 100 and the engine head 200, and leakage of combustion gas through the mounting threaded hole 201 is thereby suppressed.

The metallic shell 50 has a thin-walled crimp portion 53 extending rearward from the tool engagement portion 51. A thin-walled buckle portion 58 is formed between the flange portion 54 and the tool engagement portion 51. Annular ring members 6 and 7 are inserted between the outer circumferential surface of a rear trunk portion 18 of the insulator 10 and the inner circumferential surface of the metallic shell 50 that extends from the crimp portion 53 through the tool engagement portion 51. A space between these ring members 6 and 7 is filled with a powder of talc 9.

In a process of producing the spark plug 100, when the crimp portion 53 is bent inward and crimped, compressive force is applied to the buckle portion 58, and the buckle portion 58 is thereby buckled outward, so that the metallic shell 50 is fixed to the insulator 10. The talc 9 is compressed in the crimping step, and the airtightness between the metallic shell 50 and the insulator 10 is thereby improved.

The ground electrode 30 shown in FIG. 1 is an electrode joined to the forward end of the metallic shell 50. The distal end portion 33 of the ground electrode 30 faces the forward end of the center electrode 20.

A high-voltage cable (not shown) is connected to the terminal electrode 60 through a plug cap (not shown). As described above, to generate spark discharge between the ground electrode 30 and the center electrode 20, high voltage is applied between the terminal electrode 60 and the engine head 200 through the high-voltage cable.

Figure 2:
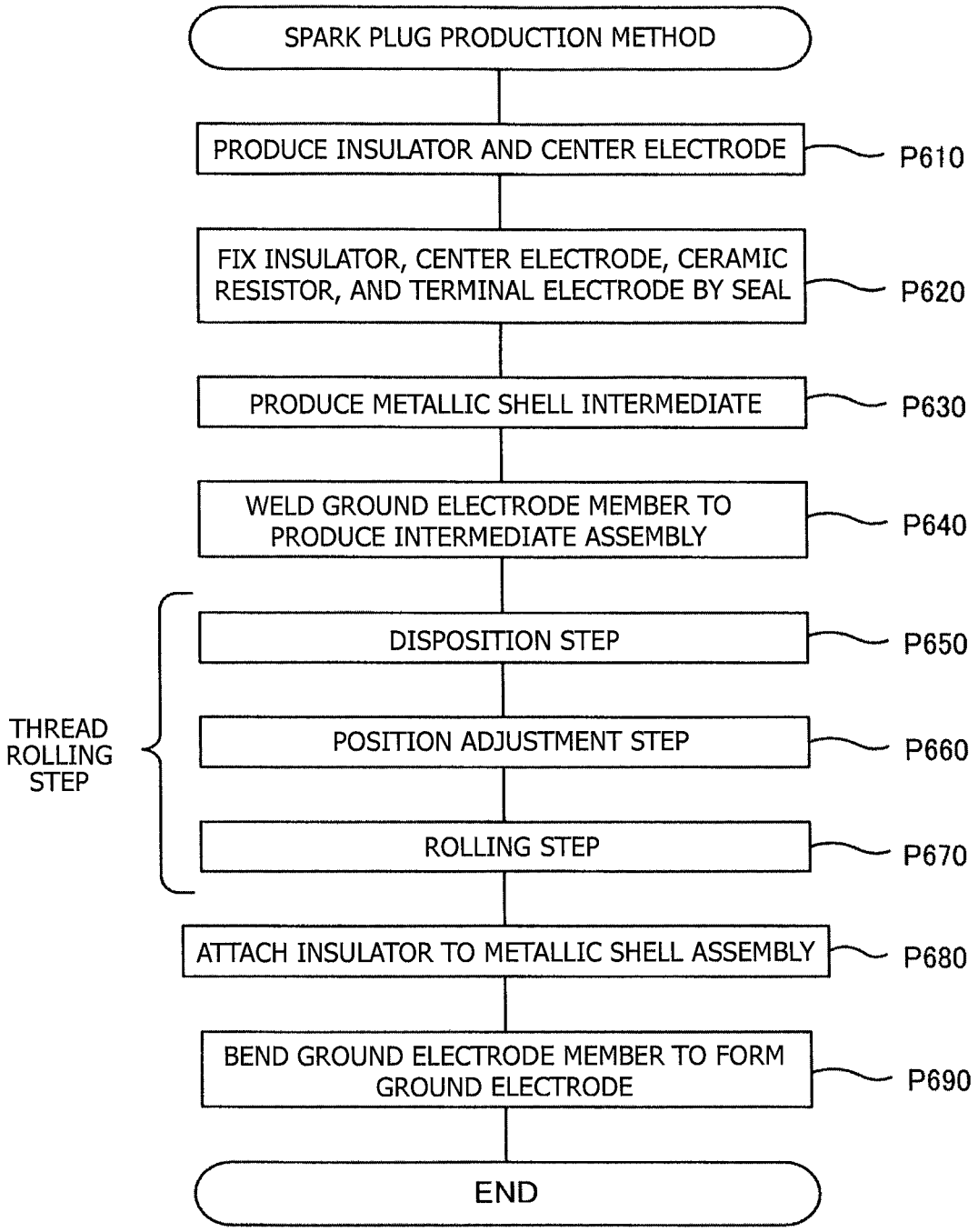
FIG. 2 is a production flowchart of the spark plug.

A method of producing the spark plug 100 will next be described. FIG. 2 is a production flowchart of the spark plug 100.

First, the insulator 10 and the center electrode 20 are produced (step P610). In the present embodiment, the following procedure is employed to produce the insulator 10. A granulated material used as a forming base material is prepared using a raw material powder containing alumina as a main component, a binder, etc. This granulated material is subjected to rubber press forming to thereby obtain a tubular compact. The obtained compact is subjected to grinding to adjust its outer shape. Then the compact is fired to thereby obtain the insulator 10.

The center electrode 20 is produced by forging a nickel alloy in which, for example, a copper alloy for improving heat dissipation is disposed at the center.

Next, the insulator 10, the center electrode 20, the ceramic resistor 3, and the terminal electrode 60 are fixed together in a sealed condition through the seal 4 (step P620). The material used for the seal 4 is, for example, a powder prepared by mixing borosilicate glass and a metal powder. The fixing in a sealed condition is performed, for example, as follows. The prepared powder is charged into the axial hole 12 of the insulator 10 so as to sandwich the ceramic resistor 3. Then, while the seal 4 is pressed from its rear side through the terminal electrode 60, the seal 4 is fired, whereby the fixing in a sealed condition by means of the seal 4 is achieved. The firing is performed by heating the entire assembly in a firing furnace. Firing of a glaze layer on the surface of the insulator 10 is performed simultaneously with or before the firing of the seal 4.

Figure 3:
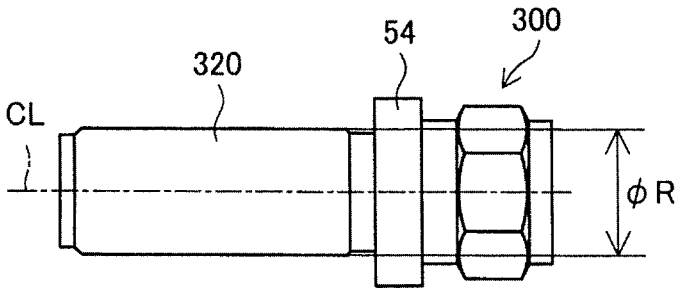
FIG. 3 a view illustrating a metallic shell intermediate.

Next, the metallic shell 50 is produced (step P630). First, a circular columnar metal material (e.g., an iron-based or stainless steel material such as S17C or S25C) is subjected to cold forging. As a result of the cold forging, a tubular member is formed. Then the tubular member is subjected to cutting to adjust its outer shape. A metallic shell intermediate 300 shown in FIG. 3 is thereby produced.

The metallic shell intermediate 300 includes a portion to be worked or machined (hereinafter referred to as a "work portion") 320 (a first portion) and the above-described flange portion 54 (a second portion). The work portion 320 extends along a center axis CL of the metallic shell intermediate 300, and the male threaded portion 52 is to be formed on the work portion 320 by rolling. The outer diameter φR of the work portion 320 is a dimension set so that a male thread of M14 is formed by rolling. The length of the flange portion 54 in a direction orthogonal to the center axis CL is longer than that of the work portion 320. Specifically, the outer diameter of the flange portion 54 is larger than φR.

The Vickers hardness of the work portion 320 in the present embodiment is 200 Hv or more and 310 Hv or less. The Vickers hardness of the work portion 320 can be measured by, for example, a method according to the provision of JIS Z 2244. Specifically, a prescribed load (e.g., 4.9 N) is applied to the work portion 320 using a regular quadrangular pyramidal diamond indenter. Then the Vickers hardness of the work portion 320 is determined on the basis of the lengths of diagonal lines of the indentation formed on the work portion 320.

Figure 4:
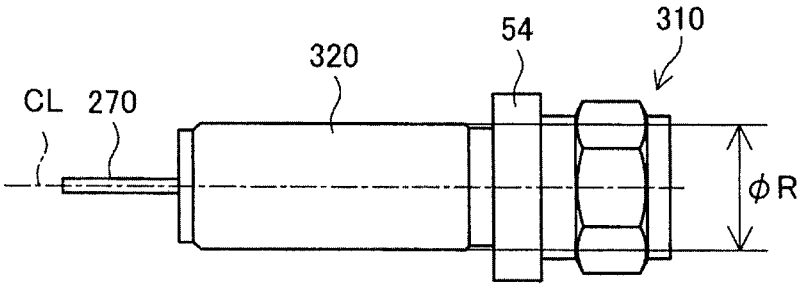
FIG. 4 is a view illustrating an intermediate assembly.

Next, a ground electrode member 270 is resistance-welded to the forward end surface of the metallic shell intermediate 300 to thereby produce an intermediate assembly 310 shown in FIG. 4 (step P640). The ground electrode member 270 is a straight rod-shaped member and later becomes the ground electrode 30. The ground electrode member 270 is formed from a material having high corrosion resistance. Specifically, the ground electrode member 270 is formed from any of nickel and alloys formed mainly of nickel (such as Inconel 600 and Inconel 601). So-called "sags" occur during the welding. Therefore, after the "sags" are removed, the male threaded portion 52 is formed in the following manner.

Figure 5:
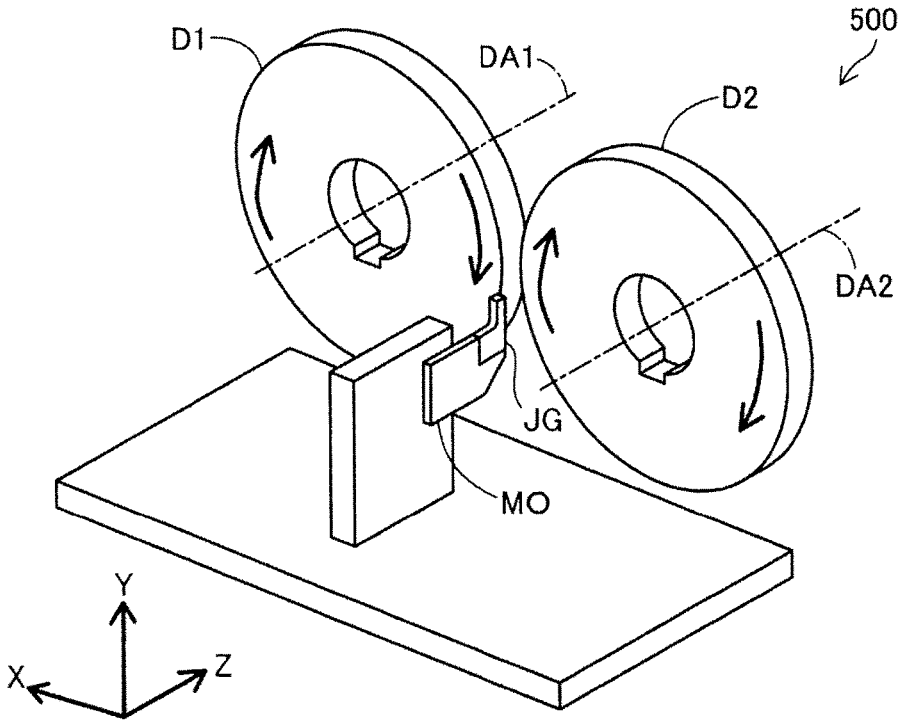
FIG. 5 is a perspective view illustrating rolling dies.

FIG. 5 is a perspective view illustrating a threaded member production apparatus 500. The threaded member production apparatus 500 includes rolling dies D1 and D2, a position adjustment jig JG, moving means MO for moving the position adjustment jig JG, and a feeding unit 400. In FIG. 5, the illustration of the feeding unit 400 (see FIG. 6) is omitted.

In the present embodiment, the mutually orthogonal XYZ axes of the right-handed coordinate system are defined as shown in FIG. 5. The X axis is parallel to a line orthogonal to both axes DA1 and DA2 which are the rotation centers of the rolling dies D1 and D2. The Y axis extends in the vertical direction, and the upward vertical direction is a positive direction. The Z axis is orthogonal to the X axis and to the Y axis. The positive direction of the Z axis is a travelling direction of a right-handed screw when it is rotated in the direction of rotation of the rolling dies D1 and D2 during rolling, as shown in FIG. 5.

The rolling dies D1 and D2 are used to form a male thread by rolling. Each of the rolling dies D1 and D2 has a circular disk shape having a thickness necessary to roll a thread, and a thread rolling surface is formed on the outer circumference of each of the rolling dies D1 and D2. The rolling dies D1 and D2 are disposed such that their rolling surfaces face each other and are rotatably supported with the axes DA1 and DA2 serving as rotation axes. The axes DA1 and DA2 are parallel to the Z axis. In FIG. 5 and other figures, the illustration of means for supporting the rolling dies D1 and D2, means for rotating the rolling dies D1 and D2, etc. is omitted.

The formation of the male threaded portion 52 (production of the threaded member) using the rolling dies D1 and D2 is achieved by a disposition step (step P650), a position adjustment step (step P660), and a rolling step (step P670).

In the disposition step, the feeding unit 400 is used to dispose the intermediate assembly 310.

Figure 6:
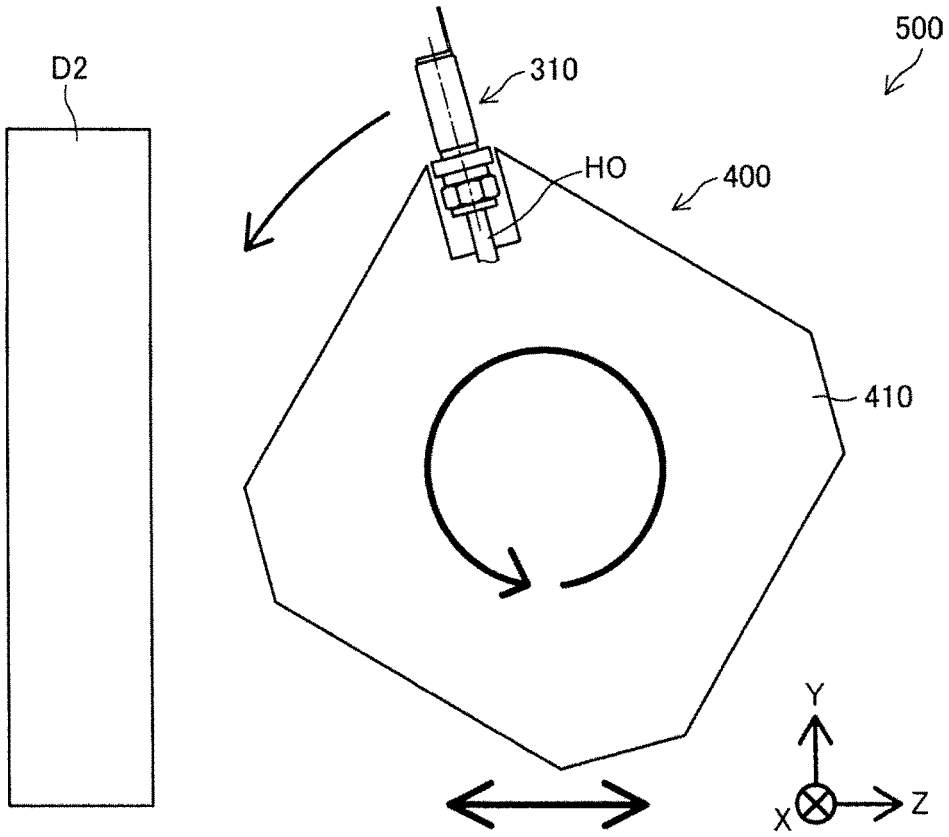
FIG. 6 is a view illustrating how the intermediate assembly is disposed by a feeding unit.

FIG. 6 shows how the intermediate assembly 310 is disposed by the feeding unit 400. The feeding unit 400 includes a turret 410 and a holding mechanism HO. The holding mechanism HO extends along a holding mechanism center axis and is attached to the turret 410. The holding mechanism HO holds one side of the intermediate assembly 310. The phrase "holds one side" means that the intermediate assembly 310 is held at one end opposite the work portion 320, as shown in FIG. 6. The turret 410 is rotatable about the X axis. The turret 410 is configured so as to be movable in the direction of the Z axis by means of an unillustrated mechanism. The rotation and movement of the turret 410 allow the intermediate assembly 310 to be disposed at a prescribed position with reference to the rolling dies D1 and D2.

FIG. 6 shows the feeding unit 400 that holds only one intermediate assembly 310. However, in practice, the feeding unit 400 is configured so as to be capable of holding up to 4 intermediate assemblies 310.

Figure 7:
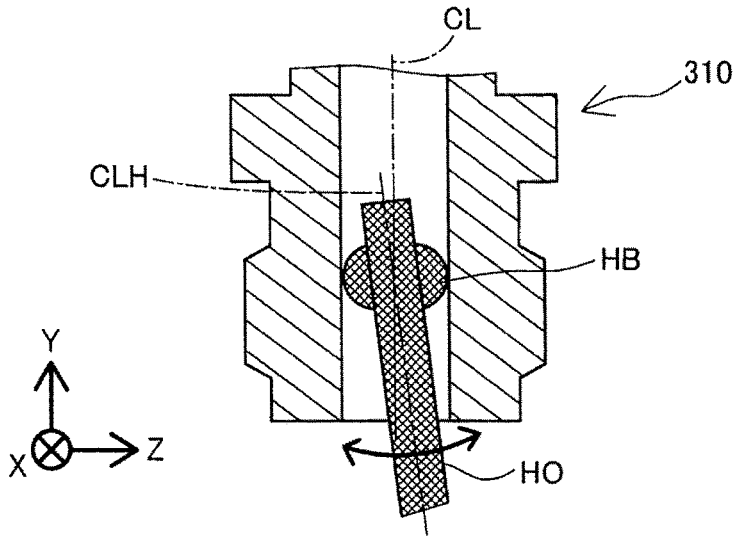
FIG. 7 is a cross-sectional view of the intermediate assembly and a holding mechanism.

FIG. 7 is a cross-sectional view of the intermediate assembly 310 and the holding mechanism HO. The holding mechanism HO is configured such that the intermediate assembly 310 is rotatable about the center axis CL. As shown in FIG. 7, the holding mechanism HO has a ball plunger mechanism, and the intermediate assembly 310 is held through the contact between balls HB and an inner wall surface of the intermediate assembly 310 which defines a through hall (a hollow space) of the intermediate assembly 310.

The ball plunger mechanism allows the holding mechanism center axis CLH, which is the center axis of the holding mechanism HO, to skew from the center axis CL of the intermediate assembly 310 to some extent, as shown in FIG. 7. This skew allows a smaller one of angles formed by the center axis CL and a projection line formed by projecting the holding mechanism center axis CLH of the holding mechanism HO onto a second virtual plane VP2 (described later with FIG. 8) (the acute angle therebetween) to be larger than 0 degrees. When no external force acts on the intermediate assembly 310, the above angle is substantially 0 degrees.

Figure 8:
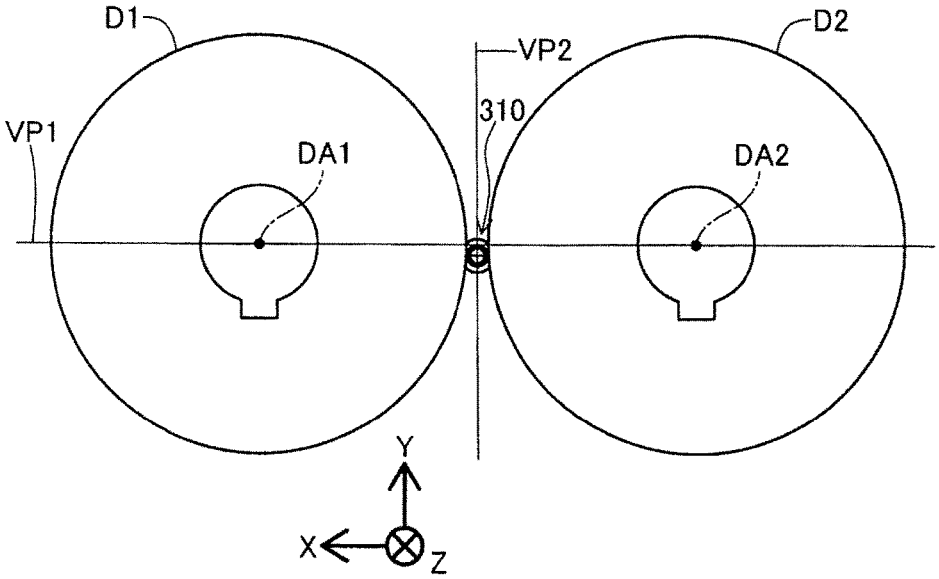
FIG. 8 is a view illustrating the intermediate assembly disposed.
Figure 9:
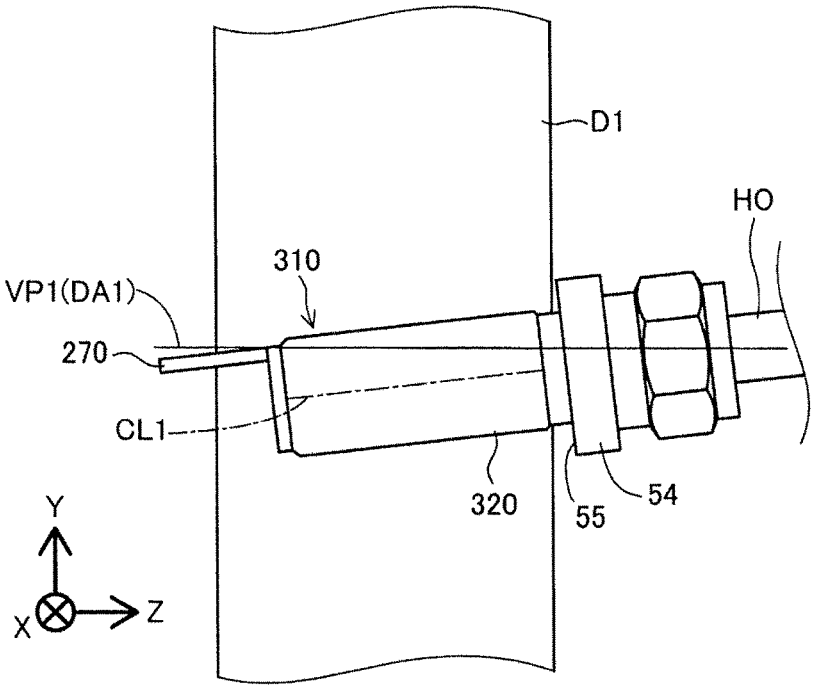
FIG. 9 is a view illustrating the intermediate assembly disposed.

FIGS. 8 and 9 show the intermediate assembly 310 disposed in the disposition step. In FIG. 8, the illustration of the feeding unit 400 is omitted. In FIG. 9, the illustration of the rolling die D2 is omitted. As shown in FIG. 9, a partial center axis CL1 of the work portion 320 is disposed on the negative side, with respect to the direction of the Y axis, of a first virtual plane VP1. The partial center axis CL1 is part of the center axis CL and is a virtual line segment extending from one end of the work portion 320 to the other end of the work portion 320 on the center axis CL. The first virtual plane VP1 is a virtual plane containing the axis DA1 of the rolling die D1 and the axis DA2 of the rolling die D2, as shown in FIG. 8.

The second virtual plane VP2 described above is defined as shown in FIG. 8. Specifically, the second virtual plane VP2 is a virtual plane orthogonal to the first virtual plane VP1 (i.e., a virtual plane parallel to the YZ plane) and is a plane containing the partial center axis CL1. The work portion 320 is a portion extending along the center axis CL, as described above, and is therefore also a portion extending along the partial center axis CL1.

As shown in FIG. 9, in the YZ plane, the partial center axis CL1 of the intermediate assembly 310 disposed in the disposition step is inclined with respect to the first virtual plane VP1. As shown in FIG. 9, when the intermediate assembly 310 held by the holding mechanism HO is inclined as described above, the distance of the partial center axis CL1 from the first virtual plane VP1 increases with distance from the flange portion 54.

Before the disposition step, the circumferential position of the ground electrode member 270 is adjusted to some extent. This adjustment is performed using positioning means such as a guide plate when the intermediate assembly 310 is fitted onto the holding mechanism HO. Therefore, the intermediate assembly 310 is disposed between the rolling dies D1 and D2 with the circumferential position of the ground electrode member 270 adjusted to some extent. Specifically, the intermediate assembly 310 is disposed with the ground electrode member 270 located at the uppermost position in the direction of the Y axis (hereinafter referred to as the "highest position"), as shown in FIG. 9. However, the circumferential position of the ground electrode member 270 is moved in the subsequent position adjustment step. Therefore, it is not necessary that the circumferential position of the ground electrode member 270 be located precisely at the highest position, and it is enough to position the ground electrode member 270 such that the subsequent position adjustment step can be performed.

After the intermediate assembly 310 is disposed between the rolling dies D1 and D2, the turret 410 is moved in the negative direction of the Z axis, and this causes part of the seat surface 55 of the intermediate assembly 310 to abut against side surfaces of the rolling dies D1 and D2.

Figure 10:
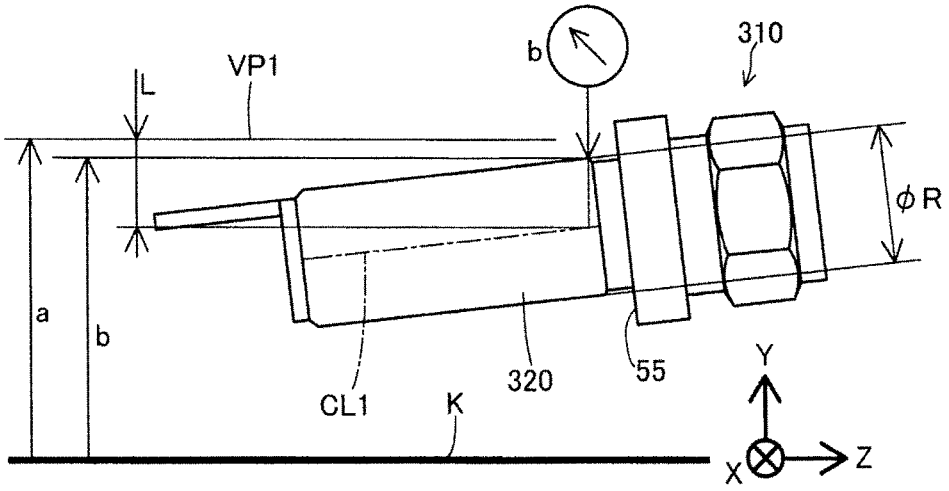
FIG. 10 is a view illustrating measurement of the distance between a partial center axis and a first virtual plane.

FIG. 10 is a view illustrating measurement of the distance L between the partial center axis CL1 and the first virtual plane VP1. As described later, there is a preferred range for the distance L. In order for the distance L to fall within this range, the distance L is measured. The distance L is measured before the disposition step. The turret 410 is positioned in the disposition step on the basis of the measurement results Since the partial center axis CL1 is inclined as described above, the distance L is measured at a position at which the distance from the first virtual plane VP1 is minimum. Specifically, the distance L is measured at a position closest to the flange portion 54. However, it is not necessary to measure the distance L at the position that gives the minimum distance strictly, and a certain error is allowed.

The first virtual plane VP1 is pre-adjusted so as to be parallel to a reference plane K shown in FIG. 10 and to be separated from the reference plane K by a prescribed distance "a." Therefore, the distance L can be determined by measuring the distance "b" of the work portion 320 from the reference plane K and the outer diameter φR of the work portion 320. Specifically, the distance L is computed using $L=a-(b-\varphi R/2)$. The distance L can be computed more accurately by correcting the distance in consideration of the inclination of the partial center axis CL1. However, since the inclination in the present embodiment is very small, the value of the distance L is almost unchanged by the correction. Therefore, in the present embodiment, the correction is not made, and the value computed using the above formula is used.

Figure 11:
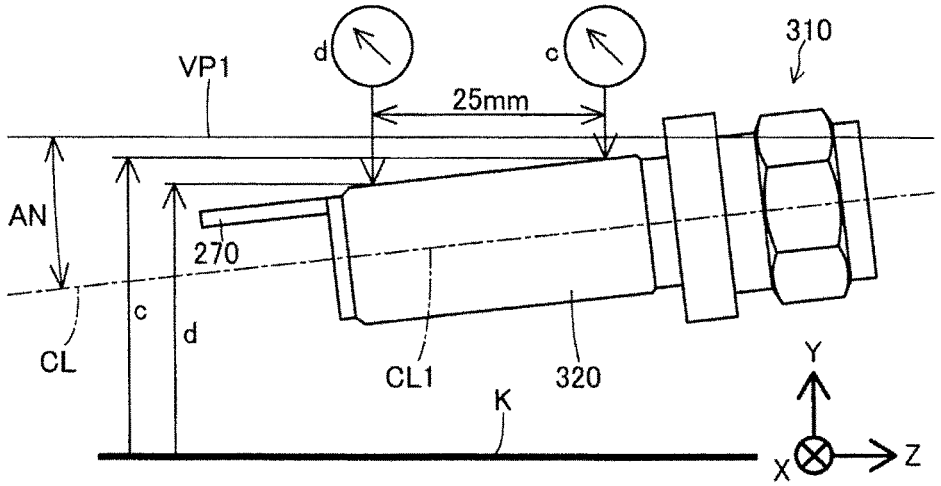
FIG. 11 is a view illustrating measurement of the inclination of the partial center axis.

FIG. 11 is a view illustrating measurement of the inclination of the partial center axis CL1 described above. The inclination of the partial center axis CL1 is represented by the angle AN between the partial center axis CL1 and the first virtual plane VP1. Since the partial center axis CL1 is included in the second virtual plane VP2, the angle AN can also be represented by the angle between the partial center axis CL1 and a line of intersection described below. This line of intersection is the line of intersection of the first virtual plane VP1 and the second virtual plane VP2. Both the partial center axis CL1 and the line of intersection are contained in the second virtual plane VP2. As described above, the angle AN is an angle in the second virtual plane VP2.

The angle AN can be determined by measuring the distance of the work portion 320 from the reference plane K at two points. These two points are separated from each other by 25 mm in the direction of the Z axis. The value measured at the measurement point farther from the ground electrode member 270 is denoted by distance c, and the value measured at the measurement point closer to the ground electrode member 270 is denoted by distance d. The angle AN is computed using AN=a tan((c−d)/25 mm). Since the angle AN in the present embodiment is very small, the value computed using AN (rad)=(c−d)/25 mm is substantially the same as the above-computed value.

Each of the values of the distances b, c, and d is computed as the average of values measured at several circumferential points while the intermediate assembly 310 is rotated about the center axis CL. For example, the intermediate assembly 310 is rotated in steps of 90 degrees, and the average of values measured at four points is computed.

After completion of the disposition step, the position adjustment step for the ground electrode member 270 is performed (step P660). The position of the ground electrode member 270 is its circumferential position about the center axis CL. To adjust the position of the ground electrode member 270, the position adjustment jig JG shown in FIG. 5 is used. As shown in FIG. 5, the position adjustment jig JG is attached to the moving means MO that is reciprocally movable in the direction of the Y axis.

Figure 12:
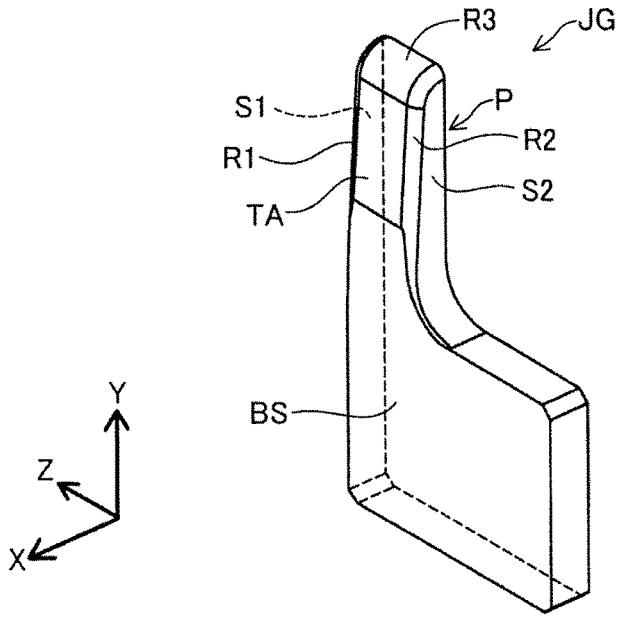
FIG. 12 is a perspective view of a position adjustment jig.

FIG. 12 is a perspective view of the position adjustment jig JG. As shown in FIG. 12, the position adjustment jig JG includes a contact portion P and a base portion BS. The base portion BS is fixed to the moving means MO. The contact portion P protrudes from the base portion BS in the positive direction of the Y axis.

The contact portion P has a front surface S1 that faces the intermediate assembly 310 (the rolling dies D1 and D2) and a rear surface S2 located on the rear side of the front surface S1. A tapered surface TA is formed between the front surface S1 and the rear surface S2. The inclination angle of the tapered surface TA is set to a relatively small value (e.g., 30 degrees or less).

A curved surface portion R1 is formed between the tapered surface TA and the front surface S1. A curved surface portion R2 is formed between the tapered surface TA and the rear surface S2. A curved surface portion R3 is formed at the forward end, with respect to the direction of the Y axis, of the position adjustment jig JG. The tapered surface TA and the curved surface portions R1, R2, R3 are smoothened surfaces.

Figure 13:
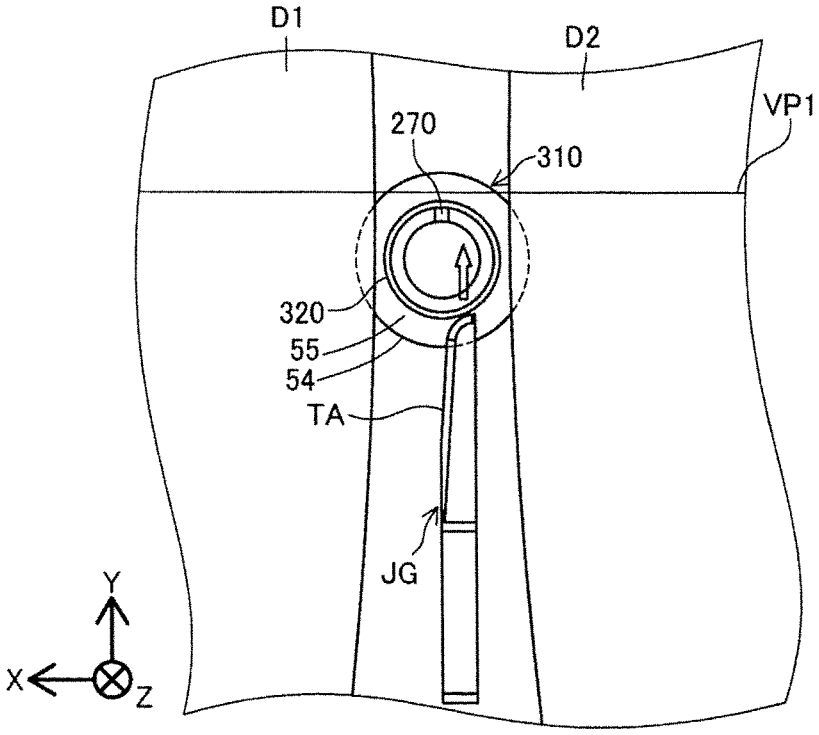
FIG. 13 is a view illustrating a position adjustment step.
Figure 14:
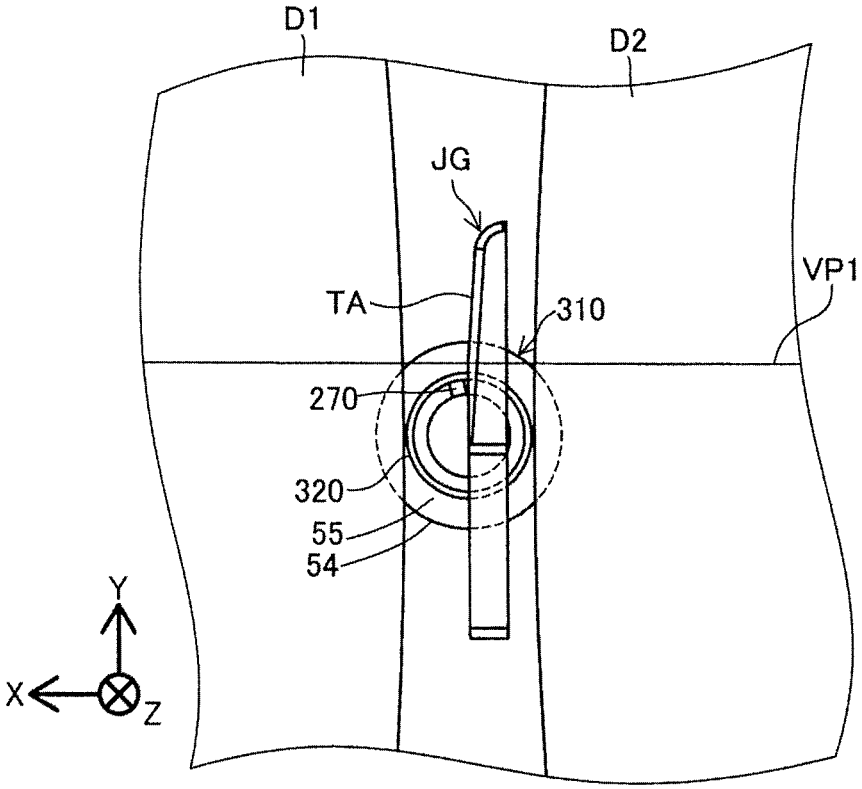
FIG. 14 a view illustrating the position adjustment step.

FIGS. 13 and 14 show the position adjustment step schematically. In FIGS. 13 and 14, the inclination of the center axis CL is set to be zero for simplifying the illustration. As shown in FIGS. 13 and 14, in the position adjustment step, the circumference position of the ground electrode member 270 is adjusted by moving the position adjustment jig JG in the positive direction of the Y axis using the moving means MO while the tapered surface TA is brought into contact with the side surface of the ground electrode member 270 with the seat surface 55 pressed against the rolling dies D1 and D2.

In this step, the moving distance of the position adjustment jig JG is preset to a prescribed value. Therefore, as shown in FIG. 14, when the position adjustment jig JG is stopped, the circumferential position of the ground electrode member 270 is adjusted to a prescribed position. After completion of the position adjustment of the ground electrode member 270, the position adjustment jig JG is separated from the ground electrode member 270 and moved back.

Next, the rolling step is performed (step P670). First, the rolling dies D1 and D2 that are not rotating are caused to approach each other to hold the work portion 320 of the intermediate assembly 310 between the rolling dies D1 and D2. With the seat surface 55 in contact with the side surfaces of the rolling dies D1 and D2, the rotation of the rolling dies D1 and D2 is started to thereby start rolling of the intermediate assembly 310.

When the rolling is started, the force acting on the intermediate assembly 310 from the rolling dies D1 and D2 causes the center axis CL to be substantially parallel to the first virtual plane VP1 and also causes the intermediate assembly 310 to move in a direction away from the rolling dies D1 and D2 (the positive direction of the Z axis).

After completion of the rolling, the rotation of the rolling dies D1 and D2 is stopped. Each time rolling of one intermediate assembly 310 (workpiece) is completed, the rotation of the rolling dies D1 and D2 is stopped as described above. Then, when a new intermediate assembly 310 is rolled, the rolling dies D1 and D2 that are not rotating are rotated. This process is referred to as in-feed rolling.

Each time the rotation of the rolling dies D1 and D2 is stopped as described above, the angular positions of the rolling dies D1 and D2 are returned to their origins. In this manner, the rolling in the present embodiment is started with the angular positions of the rolling dies D1 and D2 at their origins.

Figure 15:
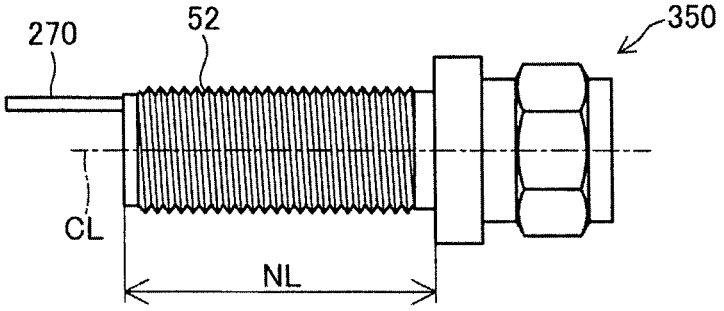
FIG. 15 is a view illustrating a metallic shell assembly.

As a result of the rolling, the male threaded portion 52 is formed on the work portion 320. The metallic shell assembly 350 is thereby produced, as shown in FIG. 15. In the present embodiment, the thread reach NL is set to be 25 mm or more and 35 mm or less.

Then the insulator 10 is attached to the metallic shell assembly 350 (FIG. 2: step P680). As described above, the insulator 10 which is to be attached to the metallic shell assembly 350 is configured as a joined assembly including the center electrode 20 and the terminal electrode 60 joined to the insulator 10. The insulator 10 is attached by inserting it into the metallic shell assembly 350 from its base end side and then crimping radially inward a relatively thin-walled rear opening portion of the metallic shell assembly 350. As a result of the crimping, the crimp portion 53 is formed.

Finally, the ground electrode member 270 is bent to thereby form the ground electrode 30 (step P690). The spark plug 100 is produced in the manner described above.

FIG. 16 is a table showing the relation between the disposition of the intermediate assembly 310 and the degree of restraint on the rising behavior. The disposition of the intermediate assembly 310 is represented by a combination of the above-described distance L and the above-described inclination of the partial center axis CL1. In FIG. 16, the inclination of the partial center axis CL1 is represented by the value of (measured distance c−measured distance d) and a measured angle (rad). The angle is a value computed from the value of (distance c−distance d) using the formula described with reference to FIG. 11.

The rising behavior is a phenomenon in which the intermediate assembly 310 or the turret 410 moves in the positive direction of the Y axis. In FIG. 16, an "A" rating is a "particularly good" rating and indicates that the rising behavior is substantially suppressed. A "B" rating is a "good" rating and indicates that the rising behavior is lower by about 60% than that for a conventional case. A "C" rating indicates that, although the rising behavior is found, the rising behavior is very small and does not cause any problem. A "D" rating indicates that the rising behavior is comparable to that in the conventional case.

As shown in FIG. 16, when the distance L is 0.005 mm or more and 0.3 mm or less and the inclination is $2\times10^{-4}$ rad or more and $40\times10^{-4}$ rad or less, the rating obtained is B or higher. Therefore, the above numerical ranges are preferred.

When the distance L is 0.05 mm or more and 0.2 mm or less and the inclination is $16\times10^{-4}$ rad or more and $24\times10^{-4}$ rad or less, an A rating is obtained (a range surrounded by broken lines in FIG. 16). Therefore, these numerical ranges are preferred. When the distance L is 0.07 mm or more and 0.15 mm or less and the inclination is $8\times10^{-4}$ rad or more and $32\times10^{-4}$ rad or less, an A rating is obtained (a range surrounded by double lines in FIG. 16). Therefore, these numerical ranges are preferred. When the distance L is 0.1 mm and the inclination is $2\times10^{-4}$ rad or more and $40\times10^{-4}$ rad or less, an A rating is obtained (a range surrounded by thick lines in FIG. 16). Therefore, these numerical ranges are preferred.

According to the present embodiment, at least the following effect can be obtained. Within the above preferred numerical ranges for the disposition of the intermediate assembly 310, the rising behavior is restrained, and the load on the holding mechanism HO is thereby reduced, so that the occurrence of a malfunction of the feeding unit 400 is restrained.

As described above, the ball plunger mechanism allows the skew between the center axis CL and the holding mechanism center axis CLH, so that the rising behavior is further restrained. During rolling, force that causes the angle AN to be reduced acts on the intermediate assembly 310. However, since the above skew is allowed, this force is absorbed, so that the rising behavior is restrained.

The intermediate assembly 310 is a hollow member, and the holding mechanism HO holds the intermediate assembly 310 through its inner wall surface defining a hollow space. Under this condition, the load on the holding mechanism HO tends to increase. In addition, the long thread reach NL (25 mm or more) and the in-feed rolling described above tend to increase the load on the holding mechanism HO. Therefore, it is particularly advantageous to restrain the rising behavior under these conditions.

Since the Vickers hardness of the work portion 320 is 310 Hv or less, reaction force acting on the rolling dies D1 and D2 is small, so that the rising behavior is restrained. Since the Vickers hardness of the work portion 320 is 200 Hv or more, the occurrence of a problem due to deformation of the work portion 320 during rolling is suppressed.

Before rolling, the position of the ground electrode member 270 is adjusted, and the angular positions of the rolling dies D1 and D2 are set to their origins. Therefore, the point at which threading is started with respect to the position of the ground electrode member 270 can fall within a prescribed range.

The present invention is not limited to the embodiment, examples, and modifications in the present specification and may be embodied in various other forms without departing from the spirit of the invention. For example, the technical features in the embodiment, examples, and modifications corresponding to the technical features in the modes described in "Summary of the Invention" can be appropriately replaced or combined in order to solve some of or all the foregoing problems or to achieve some of or all the foregoing effects. A technical feature which is not described as an essential feature in the present specification may be appropriately deleted. For example, the following can be exemplified.

The threaded member may not be a metallic shell for a spark plug and may be any member so long as it has a male thread. The threaded member may be, for example, a solid member.

The thread may have any nominal diameter. For example, the nominal diameter may be M6, M8, M10, M12, M16, M18, M20, M22, or M24.

The feeding unit may have any structure. For example, the desired disposition may be achieved by adjusting the alignment of the unit as a whole without using a rotation mechanism such as the turret.

The mechanism used to hold the workpiece may be any mechanism. For example, the outer surface of the workpiece may be held by a chuck, or opposite ends of the workpiece may be held.

The measurement position used to compute the distance L may be changed.

To compute the inclination of the partial center axis, the distance between the two points used to measure the distances from the reference plane is not required to be 25 mm and may be set freely.

The thread reach is not required to be 25 mm or more and 35 mm or less. For example, the thread reach may be 12 mm or more and less than 25 mm. Alternatively, the thread reach may be less than 12 mm, and may exceed 35 mm. Particularly, when the thread reach is 12 mm or more, the load on the holding mechanism is large. In this case, it is preferable to apply the present invention.

The second portion (the flange portion 54 in the embodiment) is not required to have a circular columnar shape so long as its length in a direction perpendicular to the center axis is longer than that of the first portion (the work portion 320 in the embodiment).

In the arrangement of the embodiment, the Y axis coincides with the vertical direction, but this is not a limitation. The Y axis may deviate from the vertical direction.

DESCRIPTION OF REFERENCE NUMERALS

3: ceramic resistor
4: seal
5: gasket
6: ring member
7: ring member
9: talc
10: insulator
12: axial hole
18: rear trunk portion
20: center electrode
21: electrode base metal
22: core
29: electrode tip
30: ground electrode
33: distal end portion
50: metallic shell
51: tool engagement portion
52: male threaded portion
53: crimp portion
54: flange portion
55: seat surface
58: buckle portion
59: screw neck
60: terminal electrode
100: spark plug

200: engine head
201: mounting threaded hole
205: mounting surface around opening
270: ground electrode member
300: metallic shell intermediate
310: intermediate assembly
320: work portion
330: seat surface
350: metallic shell assembly
400: feeding unit
410: turret
500: threaded member production apparatus
BS: base portion
CL: center axis
CL1: partial center axis
CLH: holding mechanism center axis
D1: rolling die
D2: rolling die
DA1: axis
DA2: axis
K: reference plane
O: axial line
OD: axial direction
P: contact portion
R1: curved surface portion
R2: curved surface portion
R3: curved surface portion
S1: front surface
S2: rear surface
TA: tapered surface
HB: ball
JG: jig
MO: moving means
HO: holding mechanism
VP1: first virtual plane
VP2: second virtual plane

The invention claimed is:

1. A method of producing a threaded member, the method comprising the steps of:

disposing a workpiece between two rolling dies, said workpiece having a first portion which extends in a direction of a center axis of the workpiece and on which a male thread is to be rolled, and a second portion whose length in a direction perpendicular to the center axis is longer than that of the first portion; and rolling the first portion of the workpiece by using the two rolling dies to form the male thread on an outer circumference of the first portion, wherein at least a first portion center axis that is a part of the center axis and corresponds to the first portion is separated in a prescribed direction from a first virtual plane that contains center axes of the two rolling dies, the workpiece is disposed such that the first portion center axis is inclined, and a distance of the first portion center axis from the first virtual plane increases with distance from the second portion.

2. The method of producing a threaded member according to claim 1, wherein the prescribed direction is a vertically downward direction, and a minimum distance between the first portion center axis and the first virtual plane is in a range of between 0.005 mm and 0.3 mm.

3. The method of producing a threaded member according to claim 1, wherein a smaller one of angles formed by the first portion center axis and the first virtual plane is in a range of between $2\times10^{-4}$ rad and $40\times10^{-4}$ rad.

4. The method of producing a threaded member according to claim 1, wherein, during the rolling, the workpiece is held by a holding mechanism extending along a holding mechanism center axis, and a smaller one of angles formed by the first portion center axis and a projection line formed by projecting the holding mechanism center axis onto a second virtual plane is larger than 0 degrees, the second virtual plane being perpendicular to the first virtual plane and containing the first portion center axis.

5. The method of producing a threaded member according to claim 1, wherein the workpiece has a hollow space.

6. The method of producing a threaded member according to claim 5, wherein during the rolling, the workpiece is held through an inner wall surface of the workpiece which defines the hollow space.

7. The method of producing a threaded member according to claim 1, wherein the male thread has a thread reach of 12 mm or more.

8. The method of producing a threaded member according to claim 1, further comprising the steps of:

disposing a rod-shaped member in the workpiece such that the rod-shaped member extends from a forward end of the workpiece;

adjusting of a circumferential position of the rod-shaped member about the center axis of the workpiece; and adjusting angular positions of the two rolling dies, wherein the steps of adjusting the rod-shape member and the two rolling dies are performed before the step of rolling the first portion.

9. The method of producing a threaded member according to claim 1, wherein a Vickers hardness of the first portion is 310 Hv or less before the rolling.

10. The method of producing a threaded member according to claim 1, wherein the male thread is formed on a metallic shell for a spark plug.

11. The method of producing a threaded member according to claim 1, wherein, during the step of rolling, the workpiece is held by a holding mechanism, and the holding mechanism holds one side of the workpiece in such a manner that the workpiece is rotatable about the center axis thereof.

12. The method of producing a threaded member according to claim 11, wherein the workpiece has a hollow space, the holding mechanism has balls, and the workpiece is held through contact between balls and an inner surface of the workpiece that defines the hollow space.

13. A method of producing a spark plug that includes a joined assembly in which a center electrode is joined to a tubular insulator which has an axial hole extending in an axial direction of the center electrode and holds the center electrode within the axial hole, the method comprising the steps of: inserting the joined assembly into a metallic shell produced as a threaded member; and crimping the metallic shell into which the joined assembly is inserted, wherein the threaded member is produced by a method comprising the steps of: disposing a workpiece between two rolling dies, said workpiece having a first portion which extends in a direction of a center axis of the workpiece and on which a male thread is to be rolled, and a second portion whose length in a direction perpendicular to the center axis is longer than that of the first portion; and rolling the first portion of the workpiece by using the two rolling dies to form the male thread on an outer circumference of the first portion, wherein at least a first portion center axis that is a part of the center axis and corresponds to the first portion is separated in a prescribed direction from a first virtual plane that contains center axes of the two rolling dies, the workpiece is disposed such that the first portion center axis is inclined, and a distance of the first portion center axis from the first virtual plane increases with distance from the second portion, and the male thread is formed on the metallic shell for the spark plug.

* * * * *